United States Patent [19]

Piotrowski et al.

[11] 4,020,739

[45] May 3, 1977

[54] FIRE CONTROL SYSTEM

[75] Inventors: Casimir F. Piotrowski, Riverton, N.J.; Wright H. Scidmore, Langhorne, Pa.; Robert P. O'Shaughnessy, Voorhees; Nicholas P. Marasco, Beverly, both of N.J.; Louis R. Cerrato, Philadelphia; Clarence C. Haines, Jr., Levittown, both of Pa.

[73] Assignee: The United States of America as represented by the Secretary of the Army, Washington, D.C.

[22] Filed: July 16, 1976

[21] Appl. No.: 705,981

[52] U.S. Cl. ..... 89/41 ME; 89/41 L; 356/152

[51] Int. Cl.[2] ..... F41G 3/32

[58] Field of Search ..... 89/41 R, 41 B, 41 E, 89/41 ME, 41 L; 356/141, 152, 153, 154

[56] References Cited

UNITED STATES PATENTS 3,684,383 8/1972 Johansson ..... 356/152

*Primary Examiner*—Stephen C. Bentley

*Attorney, Agent, or Firm*—Nathan Edelberg; Robert P. Gibson; Arthur I. Spechler

[57] ABSTRACT

A fire control system for aiming a cantilevered adjustably mounted gun includes a flat muzzle mirror fixed to the muzzle of the gun. A light source, disposed within a gunner's periscope, directs a beam of light onto a movable mirror, in the periscope, which reflects the beam normal to the muzzle mirror only in the absence of gun to periscope positioning errors for all positions of the gun. The reflected beam from the muzzle mirror impinges on a charge coupled detector matrix array; and, depending upon the portion of the array impinged upon, provides compensatory azimuth and elevational error signals which are algebraically added to azimuth and elevational range signals produced by a ballistic computer in response to a range finder sighted on a target. The compensated azimuth and elevational signals are employed to position a movable reticle correctly in the periscope to enable the gunner to aim the gun accurately, whereby to increase the first round hit probability.

7 Claims, 5 Drawing Figures

FIRE CONTROL SYSTEM

The invention described herein may be manufactured, used and licensed by or for the Government for governmental purposes without the payment to us of any royalty thereon.

BACKGROUND OF THE INVENTION

This invention relates generally to fire control systems. More particularly, the invention relates to a fire control system of the type utilizing a periscope for aiming a cantilevered adjustably mounted gun. The present invention is particularly, though not exclusively, useful for enabling a gunner to accurately aim a gun cantilevered mounted on a military tank.

DESCRIPTION OF THE PRIOR ART

It has been proposed for a gunner in a tank to aim a cantilevered adjustably mounted gun at a target by observing the target through a periscope. A movable (head) mirror in the periscope is structurally linked to the gun to provide an image of the target at which the gun is pointing. The gun, however, must be elevated from the periscope line-of-sight (LOS) to allow for the non-linear ballistic trajectory of the gun's projectile. This correction, called "superelevation", is computed from information providing the target range, the velocity of the projectile, and various other parameters. A ballistic computer, on board the tank, uses this information to determine the proper superelevation correction to be applied for each selected target, in a manner well known in the art.

As the gun is elevated, a ballistic drive linkage, such as a mechanical differential, for example, translates this motion to the periscope by rotating a periscope (head) movable mirror. Thus, the periscope LOS is linked to the gun direction, and the angle of elevation of the gun differs from that of the head mirror only by the computer solution of the superelevation correction introduced to the head mirror through the ballistic drive. In actual practice, however, the superelevation correction is not always exact because of mechanical tolerances in the linkages, lost motion caused by mechanical wear, lack of preventive maintenance, and other "on-vehicle" equipment errors, hereinafter to be discussed. Additionally, errors in the superelevation correction are also caused by the bending of the gun barrel due to uneven thermal stresses, wind, and/or gravity. The aforementioned errors are not constant over time or operating conditions.

The novel fire control system comprises means for compensating for errors which cause a projectile to be aimed in a direction other than that which is required. These errors which are hereinafter referred to as "gun to periscope positioning errors" for all positions of the gun can be sufficiently large to cause the projectile to miss the target. These errors can be grouped into three categories:

1. Gun tube deformations,
2. Ballistic linkage errors, and
3. Alignment errors.

The first category has two components; (a) that due to gravity effects on the cantilevered gun (gun droop), and (b) that due to the thermal effects of solar radiation (unequal heating), cross winds (uneven cooling), and gun firing. The second category of errors is due to parallelogram linkage errors, ballistic drive errors, and periscope coupling errors. The third category includes the boresighting and zero-fire errors, and the mechanical tolerances associated with the system's components.

SUMMARY OF THE INVENTION

The improved fire control system of the present invention substantially compensates for the aforementioned errors by employing electronic and electrooptical techniques that measure the total system error and compensate for it by entering correction factors (azimuth and elevation error signals) into the ballistic computer for both the lateral (azimuth) and elevational coordinates that determine the gun's position. These error signals correct (accurately position) the gunner's adjustable reticle in the periscope accordingly to increase first round hit probability.

In a preferred embodiment of the novel fire control system, including a periscope, a ballistic computer and a range finder, a flat muzzle mirror is fixed to the muzzle of a cantilevered mounted gun. A light source is disposed to direct a collimated beam of light in a path from a movable (rotating) head mirror of the periscope to the muzzle mirror, impinging thereon at a right angle thereto only in the absence of gun to periscope positioning errors for all positions of the gun, and returning to the movable mirror and, as a reflected ray, impinging upon a matrix array of photosensitive means. Circuit means are connected between the matrix array and the ballistic computer to provide azimuth and elevational error signals in response to the portion of the matrix array receiving the reflected ray. The azimuth and elevational error signals are algebraically added to azimuth and elevational range signals provided by the ballistic computer in response to the range finder, to adjust the gunner's reticle in the periscope so as to compensate for the aforementioned errors.

The novel features of this invention, as well as the invention itself, both as to its organization and operation will best be understood from the accompanying drawings, taken in conjunction with the accompanying description, in which similar reference characters refer to similar parts, and in which:

DESCRIPTION OF THE PREFERRED EMBODIMENTS

Figure 1:
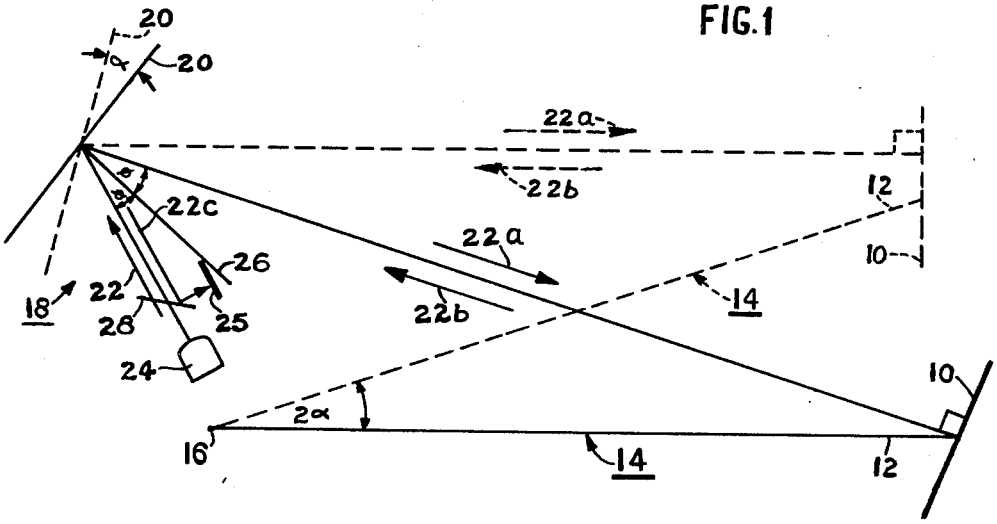
FIG. 1 is a schematic diagram of the geometry, represented by a cantilevered mounted gun, a muzzle mirror mounted on the muzzle of the gun, and a periscope, the gun being shown in two positions to illustrate the principles of operation of the novel fire control system.

Referring now to FIG. 1 of the drawing, there is shown schematically a muzzle mirror 10 rigidly mounted on the muzzle 12 of a cantilevered adjustably mounted gun 14. The gun 14 is shown in two positions; the boresighting position (horizontal) and an elevated position (dash lines). The gun 14 is movable in elevation about a trunnion 16. The gun 14 can also be moved laterally (in azimuth), as when mounted on a turret of a military tank. A periscope 18 comprises a movable (rotating head) mirror 20 which is mechanically adapted to move synchronously with the gun 14.

In accordance with the principles of operation of the novel fire control system, the fixed muzzle mirror 10, which may comprise a planar elongated sheet of a light-reflected metal, is disposed so that a beam 22 of light from a light source 24 in the periscope 18 is reflected by the head mirror 20 and impinges (as reflected beam 22*a*) upon the muzzle mirror 10 normal thereto only in the absence of gun to periscope positioning errors for all positions of the gun 14. The reflected beam 22*a* is reflected by the muzzle mirror 10 as reflected beam 22*b*. The arrows adjacent to the reflected portions of the beam 22 indicate the directions of these portions. As the gun 14 is raised in elevation (to the dash line position) through an angle of $2\alpha$, for example, the periscope head mirror 20 and its normal 26 are displaced by an angle $\alpha$. During the elevation of the gun 14, the light source 24 and a light detector 25, disposed to receive a reflected ray 22*c* from the head mirror 20, hereinafter to be explained in detail, remains in a fixed position. An important feature of the present invention is that the reflected beams 22*a* and 22*b* (between the head mirror 20 and the muzzle mirror 10) remain normal (perpendicular) to the muzzle mirror 10 during the range (about 20°) of the elevation and depression of the gun 14 only in the absense of gun to periscope positioning errors for all positions of the gun 14. Since this geometry (FIG. 1) provides a constant normal to the muzzle mirror 10 with a fixed light source 24 and the detector 25, in the absence of errors, all gun to periscope error deviations in both azimuth and elevation can be measured with the collimated light beam transmitted to, and reflected from, the muzzle mirror 10. The structure, illustrated by the geometry of FIG. 1, obviates the needs for moving parts (other than for establishing a boresight reference) and for a trunnion reference. This structure also provides a closed error system that accounts for the aforementioned cantilevered gun errors in both azimuth and elevation, as well as errors in the periscope to gun synchonization.

Figure 3:
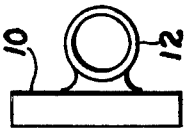
FIG. 3 is a front elevational fragmentary view of the gun and muzzle mirror.
Figure 2:
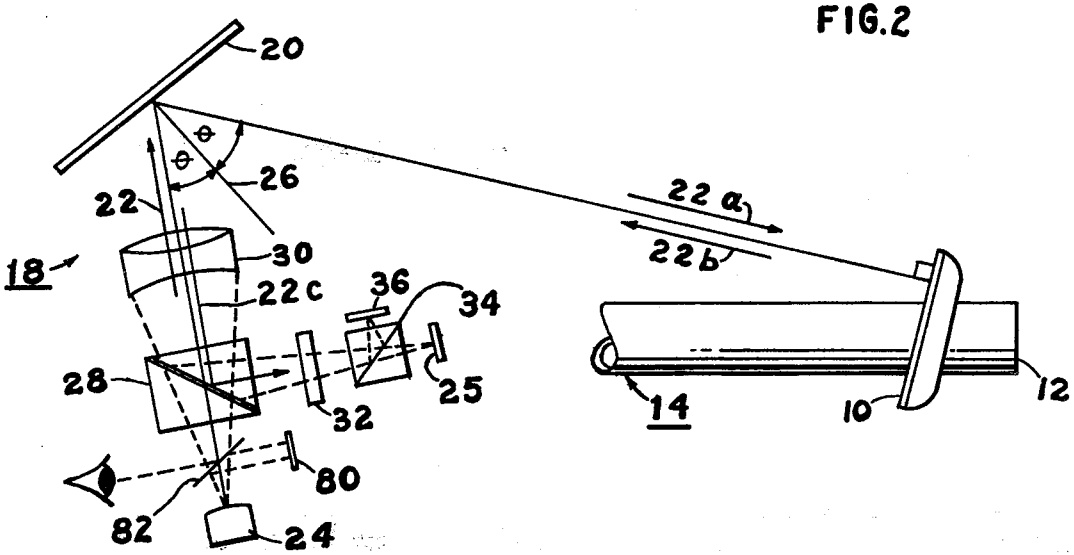
FIG. 2 is a schematic diagram of the geometry of the novel fire control system, showing the positions of the periscope, gun, and muzzle mirror in greater detail.

Referring now to FIGS. 2 and 3 of the drawing, there is shown the periscope 18 comprising the light source 24, a first beam splitter 28, a collimator lens 30, and the movable (rotatable) head mirror 20. The light source 24, preferably a light emitting diode (LED), generates, when suitably energized, light rays that pass along a path in the beam 22. The beam 22 passes through a first beam splitter 28, through the lens 30, is reflected by the head mirror 20 (as reflected beam 22*a*), is reflected by the muzzle mirror 10 (as reflected beam 22*b*), is reflected by the head mirror 20 (as reflected beam 22*c*), and is directed through the lens 30. The reflected beam 22*c* is now directed through the first beam splitter 28, through a narrow band optical filter 32, through a second beam splitter 34, and then focused onto both the detector 25, a four-quadrant, photosensitive, matrix array, and focused onto an automatic-gain-control (AGC) light source detector 36.

The light source 24 is preferably a LED that emits light in the infra-red range. The optical filter 32 is used to substantially eliminate light rays other than the infra-red rays from the matrix array detector 25; and the AGC detector 36 is employed in a feed-back circuit well known in the art, to maintain the output of the LED within a desired operating intensity.

A one-tenth milliradian sensing accuracy, at the matrix array detector 25, can be achieved by the optical system described in FIG. 2 when the detector 25 and the light source 24 are disposed at the focus of the lens 30, as shown in FIG. 2. The reflected beam 22*a* is in a fixed angular relationship to the periscope LOS, and the reflected beam 22*a* would ordinarily intersect the muzzle mirror 10 at an angle normal to the muzzle mirror 14 in the absence of any gun to periscope positioning errors, regardless of the gun 14 elevation. In the presence of an error, the beam 22*a* does not impinge upon the muzzle mirror 10 normal thereto. The angles $\theta$ of incidence and reflection, however, at the head mirror 20 depend only on the alignment errors, such as gun droop and linkage type errors.

The quadrant matrix array detector 25 is preferably a photosensitive device, such as a Fairchild CCD201, solid state self-scanning image sensor 100 × 100 element charge coupled device. The spectral response of the device is from 480 to 1100 nm with a peak response at approximately 740 nm. The responsivity of the device is 400 to 600 mv/ft-c based upon a cycle repetition rate of 40Hz and a tungsten light source at 2854° K temperature. The conversion factor for using the LED light source 24 in place of the 2854° K is a factor of approximately 3.

The resolution of the detector 25 is based upon the matrix array of the individual sensors on 1.3 milliradians × 1.6 milliradians centers. The 100 × 100 element array detector 25 permits better than 0.1 milliradian resolution for a ± 3 milliradians total error compensation in azimuth and ± 4 milliradians in elevation.

The photosensitive detector 25 can also be a charge injection device (CID) sensor, with a 188 × 244 element format of the type used in General Electric Solid State Television cameras.

The novel fire control system processes the collimated light beam 22 so that all gun to periscope positioning errors can be detected and compensation provided automatically by the ballistic computer in the tank or vehicle. The ballistic computer determines the lateral (azimuth) and elevational range coordinates for positioning the gun 14 in response to a rangefinder and other firing parameters in a manner well known in the art. Suitable ballistic computers for use with the novel fire control system of the present invention can be of the types described in U.S. Pat. No. 3,733,465 for a Log-Base Analog Ballistics Computer and U.S. Pat. No. 3,575,085 for an Advanced Fire Control System, and the ballistic computer and fire control system of these patents are incorporated herein by reference. In the novel fire control system of the present invention the 100 × 100 solid state matrix array detector 25 is utilized as a four-quadrant detector for measuring ± 3 milliradians in azimuth and ± 4 milliradians elevation to a 0.1 milliradian accuracy.

Figure 4:
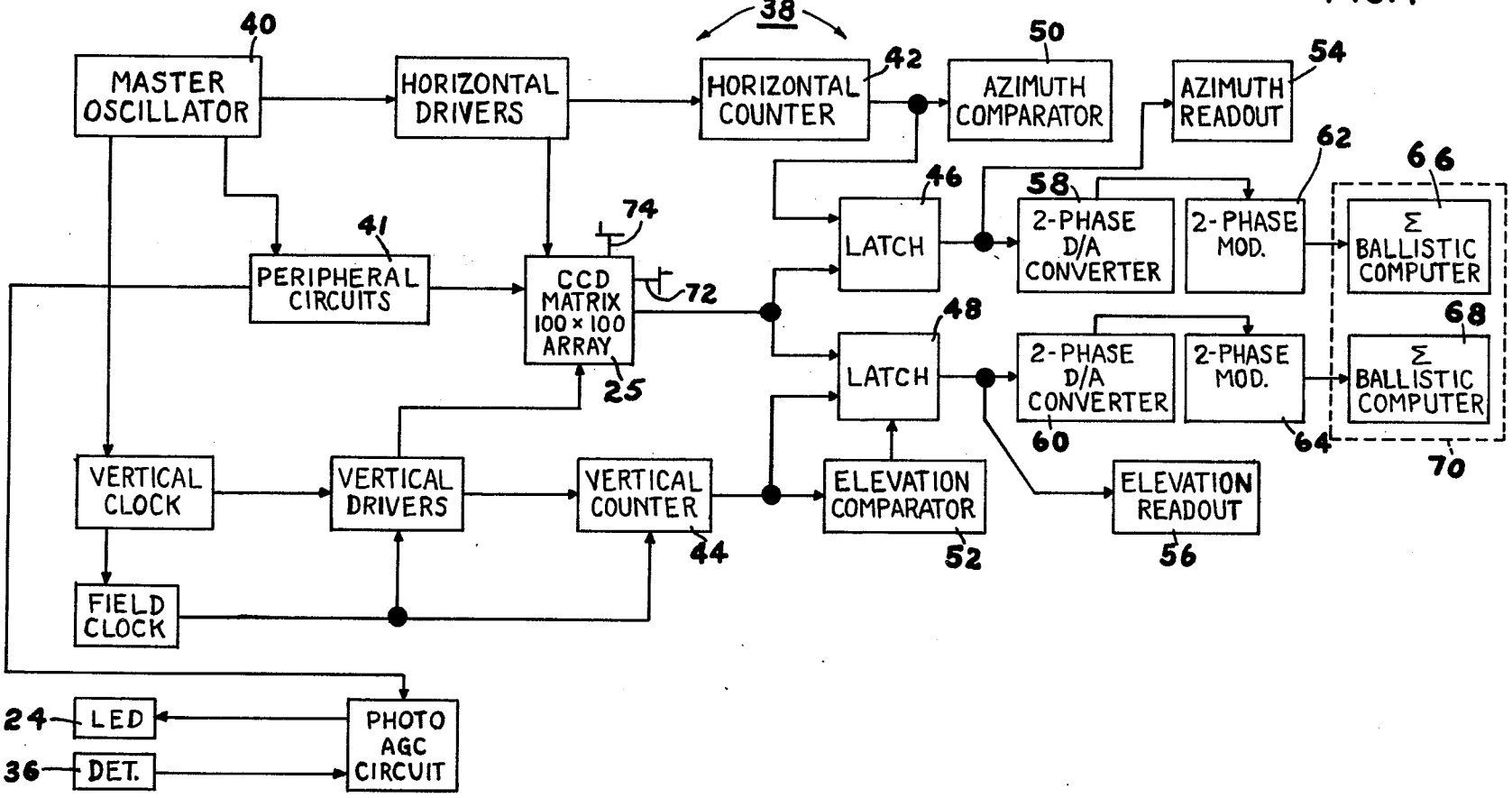
FIG. 4 is an electronic flow diagram of circuitry for interfacing error signals, obtained by the novel fire control system, with an on-board ballistic computer.

Referring now to FIG. 4, there is shown an electronic flow diagram 38 for processing the azimuth and elevational error signals that are indicated by the position of the reflected ray 22*c* impinging upon the matrix array detector 25. A master clock 40, with associated circuitry well known in the art, generates a photogate, horizontal and vertical drive pulses. During the photogate time, the LED 24 is "on" and the reflected ray 22*c* is focused onto the matrix array detector 25. At the end of the photogate, the resultant stored information is serially shifted out of the matrix array detector 25 a row at a time. Since the matrix array detector type chosen is a television-type device, a 2:1 interlace readout format is used, in a manner well known in the television art.

During the information transfer from the four quadrant matrix array detector 25, the horizontal and vertical pulses are counted in the horizontal and vertical counter circuits 42 and 44, respectivily, and gated with the video information such that the $(x,y)$ coordinate position of the reflected ray 22*c* at the matrix array detector 25 can be determined with respect to the center of the matrix array detector 25. This information is now present, as error signals, at latch and comparator circuits 46, 48, and 50, 52, respectively, in both azimuth and elevation channels. The latch circuits 46 and 48 store the coordinate information of each of the channels, and this information is available for azimuth and elevation visual readout circuits 54 and 56, as well as for two-phase digital to analog conversion through circuits 58 and 60. The analog signals are further processed by two two-phase modulator circuits 62 and 64 and are available to the respective azimuth and elevation summation channels 66 and 68 of the normally on-board ballistic computer 70. The two-phase circuitry is required only for interfacing with are analog ballistic computer 70, as, for example, the ballistic computer M19 in the M60A2 military tank.

The comparator circuits 50 and 52 are used to place a 4 milliradians limit in elevation and 3 milliradians limit in azimuth to each respective location of a quadrant of the matrix array detector 25 such that if the total vehicle errors exceed this amount during operation, the last bit of information is stored and maintained until subsequent error information reduces the comparator threshold. Thus, some information is always presented to the ballistic computer 70.

Visual readouts (from circuits 54 and 56) in each channel are used for manually adjusting the matrix array detector 25, as with the horizontal and vertical adjustable lead screws 72 and 74, respectively, for centering during boresight. In other words, when the gun 14 is horizontal (boresight position), the matrix array detector 25 is adjusted by the horizontal and vertical lead screws 72 and 74 so that the reflected (focused) ray 22*c* impinges upon the center of the matrix array detector 25, the common point of the four-quadrants of the matrix array detector 25.

Figure 5:
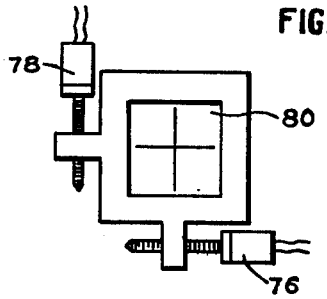
FIG. 5 is an enlarged elevational view of a gunner's reticle in the periscope.

Thus, the azimuth and elevation error signals from the latch circuits 46 and 48 are interfaced with the on-board ballistic computer 70 and algebraically summed to provide the resultant azimuth and elevation signals. The latter resultant signals determine the accurate positioning of the gun by (feed-back) ballistic drive means to horizontal and vertical positioning motors 76 and 78, respectively, connected to the reticle 80 (FIG. 5) in the periscope 18. The reticle 80 is viewed by the gunner through a beam splitter 82, shown in FIG. 2.

Thus, there has been provided a novel fire control system that compensates for all "on-vehicle" errors over the entire span of gun quadrant elevation. Additionally, since the novel components are integrated into the gunner's periscope, with nothing except the muzzle mirror 10 mounted externally, the novel fire control system vulnerability has been reduced to that of the muzzle mirror itself.

We claim:

1. In a fire control system of the type utilizing a periscope for aiming a cantilevered adjustably mounted gun, and having means to move a movable (rotatable) mirror in said periscope cooperatively with said gun, said system including a range finder cooperatively associated with a ballistic computer for supplying lateral (azimuth) and elevational range signals responsive to said range finder for a predetermined target, and means responsive to said range signals to adjust an adjustable reticle in said periscope for aiming said gun at said target, the improvement comprising a flat muzzle mirror fixed to a muzzle of said gun, a light source disposed to direct a beam of light in a path onto said movable mirror, said beam to be reflected from said movable mirror and to impinge upon said muzzle mirror at a normal thereto only in the absence of gun to periscope positioning errors for all positions of said gun, said beam to be reflected back from said muzzle mirror to said movable mirror, and to be reflected from said movable mirror, as a reflected ray, into said periscope, a matrix array of photosensitive means disposed to receive said reflected ray on only a portion of said matrix array, circuit means connected between said matrix array and said computer to provide lateral and elevational error signals in response to said portion of said matrix array receiving said reflected ray, and means to algebraically add said lateral and elevational error signals to said lateral and elevational range signals to adjust said reticle, whereby to compensate for errors due to the cantilevered mounting of said gun.

2. In a fire control system of the type described in claim 1, wherein:

said periscope comprises a first and a second beam splitter, and a collimating lens, said light source being within said periscope and disposed to project said beam of light in a path through said collimating lens and said first beam splitter, and onto said movable mirror, said first and said second beam splitters being disposed to receive said reflected ray from said movable mirror and to direct it to said matrix array, an automatic gain control detector disposed adjacent said second beam splitter to receive a portion of said reflected ray, and a filter disposed in the path of said reflected ray.

3. In a fire control system of the type described in claim 1, wherein:

said adjustably mounted gun is pivoted about a trunnion, and said movable mirror is mechanically slaved to said gun to move therewith to that said beam of light always impinges upon said muzzle mirror at a normal thereto for the full range of the elevation and depression of said gun in the absence of gun to periscope positioning errors.

4. In a fire control system of the type described in claim 1, wherein:

said adjustable recticle is within said periscope and comprises motor means to move it horizontally and/or vertically in response to said signals from said computer.

5. In a fire control system of the type described in claim 1, wherein:

said flat muzzle mirror comprises a planar elongated sheet of a light-reflecting material, and said muzzle mirror is rigidly fixed to the muzzle of said gun and disposed to receive and reflect said beam of light for all operable positions of said gun.

6. In a fire control system of the type described in claim 1, wherein:

said light source is a light emitting diode in the infrared range, and said light source is disposed within said periscope.

7. In a fire control system of the type described in claim 1, wherein:

said matrix array is a charge coupled matrix array detector divided into four quadrants, disposed within said periscope, and said circuit means comprises means for counting and gating positional information in response to said reflected ray on said matrix array; whereby to provide said lateral and elevational error signals as a function of the coordinate position of said reflected ray on said matrix array with respect to a reference position, said reference position being the center of said matrix array.

* * * * *